United States Patent [19]

Stockdale

[11] 4,156,235

[45] May 22, 1979

[54] APPARATUS FOR ACTIVATING OR DEACTIVATING AN INTRUSION DETECTION SYSTEM FROM A PLURALITY OF REMOTE LOCATIONS

[75] Inventor: Roy Stockdale, Huntington, N.Y.

[73] Assignee: Napco Security Systems, Inc., Copaigue, N.Y.

[21] Appl. No.: 889,256

[22] Filed: Mar. 23, 1978

[51] Int. Cl.[2] ..... G08B 13/08

[52] U.S. Cl. ..... 340/541; 340/652

[58] Field of Search ..... 340/500, 541, 652, 654

[56] References Cited

U.S. PATENT DOCUMENTS

| | | | |
|---|---|---|---|
| 3,441,929 | 4/1969 | Coffer et al. | 340/541 |
| 4,074,248 | 2/1978 | Stockdale | 340/541 |

*Primary Examiner*—Alvin H. Waring

*Attorney, Agent, or Firm*—Arthur L. Plevy

[57] ABSTRACT

An intrusion detection system can be armed and disarmed from a plurality of remote locations by the use of a plurality of momentary switches, each one associated with one of said locations. Each switch when depressed, functions to change the state of a flip/flop. The flip/flop in one mode operates to disarm the intrusion detection system. When the flip/flop is in its other mode, the intrusion detection system is armed and activated. The apparatus monitors the state of the control loop associated with the detection system in order to indicate to a user that the system can be activated or armed when desired. If the control loop is not secure, the apparatus will indicate this fact to the user to enable him to secure the loop before arming the system by triggering of the flip/flop.

10 Claims, 1 Drawing Figure

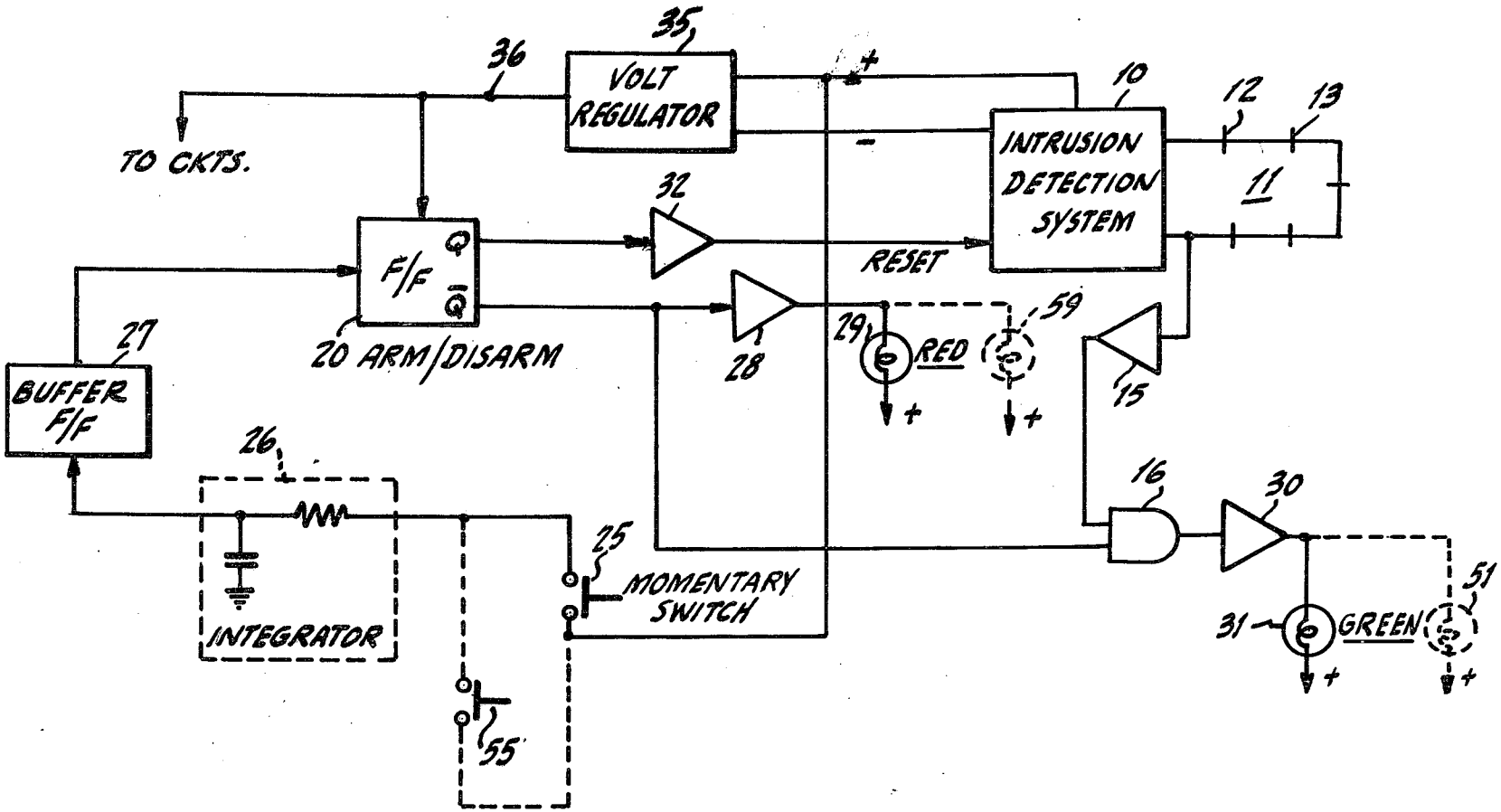
INTRUSION DETECTION SYSTEM
VOLT REGULATOR
F/F
BUFFER F/F
INTEGRATOR
MOMENTARY SWITCH
RESET
RED
GREEN
TO CKTS.
20 ARM/DISARM
10
11
12
13
15
16
25
26
27
28
29
30
31
32
35
36
51
55
59

APPARATUS FOR ACTIVATING OR DEACTIVATING AN INTRUSION DETECTION SYSTEM FROM A PLURALITY OF REMOTE LOCATIONS

BACKGROUND OF INVENTION

This invention relates to intrusion detection systems in general and more particularly, to apparatus for enabling one to arm or disarm such a system from a plurality of remote locations.

Intrusion detection systems conventionally monitor a premises for a burglary or fire and operate to sound an alarm in the event such an intrusion occurs. As is well known, the systems are in widespread use both on residential and commercial properties. The systems are normally activated or armed or deactivated or disarmed by means of a mechanical switch. The switch is usually operated by a suitable key and exists normally at one location. Thus, the user can turn the system off and on by means of the mechanical switch when he enters or leaves the premises. It can be seen that the mechanical switch can only be located at one location due to the fact that when the switch is off which indicates a reset condition, one cannot bypass the switch at another location due to the mechanical nature of the switch.

There exists techniques in the prior art which employ relays or electromechanical devices operated from such mechanical switches to enable the arming or disarming of such systems at remote locations. These systems are difficult to implement and require relatively expensive components.

It is an object of the present invention to provide circuitry to enable the arming or disarming of an intrusion detection system from a plurality of locations located as desired about a premises secured by such a system. The circuitry enables a user to determine the status of the system at each location, so that the user can immediately visualize whether the system is armed or disarmed.

BRIEF DESCRIPTION OF PREFERRED EMBODIMENT

In an intrusion detection system of the type operative to monitor an intrusion on a secured premises, said intrusion detection system operating to detect an open circuit in a loop of detector devices which loop is normally closed when the premises are secured, said intrustion detection system having an input terminal for arming said system upon application of a first signal thereto and for disarming said system for application of a second signal thereto, the combination therewith of apparatus for arming or disarming said system, comprising first means coupled to said loop and operative to provide at an output a first status signal when said loop is closed and a second status signal when said loop is opened, a first momentary switch adapted when operated to provide a pulse at an output, a bistable multivibrator having an input terminal, and a first and second output terminal, said first output terminal coupled to said input terminal of said detection system operative to provide said first signal when said multivibrator is operated in a first state and said second signal when said multivibrator is operated in a second state, said second output terminal adapted to provide a signal indicative of said second signal when said multivibrator is operated in said first state and a signal indicative of said first signal when said multivibrator is operated in said second state, logic means having one input terminal coupled to said output of said first means and a second input coupled to said second terminal of said bistable to provide an output signal during the presence of said first status signal and for said bistable operated in said first mode, said output signal indicative of said loop being closed and said intrusion system being disarmed, means coupling said output of said momentary switch to said input terminal of said bistable to alter said states of said bistable according to the operation of said momentary switch to therefore selectively arm or disarm said system according to said output signal as provided by said logic means.

BRIEF DESCRIPTION OF THE FIGURE

The sole FIGURE is a block diagram of an intrusion detective system employing apparatus according to this invention.

DETAILED DESCRIPTION OF THE DRAWINGS

Referring to the FIGURE, there is shown an intrusion detection system 10. As indicated, such systems are conventionally used to monitor and guard a premises against unauthorized intrusions such as burglary, fire and so on. Such systems conventionally operate with a loop 11 consisting of closed sensors such as 12 and 13 which may monitor doors, windows associated with the premises.

As is known, if the loop 11 is closed, then all the monitored exits or entrances are secured and the system can be armed or activated as desired.

Shown coupled to the loop 11 is a gate 15. The gate 15 exhibits one output when the loop is closed and another output when the loop is opened. The output of gate 15 is coupled to one input of an AND gate 16. The other input to AND gate 16, as will be explained, is derived from a flip/flop 20 designated as an armed/disarmed or arm/disarm flip/flop.

Shown on the FIGURE is a momentary switch 25. The switch 25 is a conventional momentary switch and produces a pulse output when activated. The switch 25 may be a pushbutton type or may be key operated. The output of the switch 25 is coupled to an integrator circuit 26. The function of the integrator circuit 26 is to eliminate transients caused by contact bounce associated with the switch 25.

The output of the integrator is coupled to the set input of a bistable circuit 27. The circuit 27 produces a sharp pulse at its output each time the switch 25 is operated. The output of the buffer flip/flop 27 is applied to the clock input of the arm disarm flip/flop 20. One output $\bar{Q}$ is coupled to an input of a lamp driver amplifier 28. The output of amplifier 28 is coupled to a lamp 29 which is designated as RED. The output is also coupled as described above to another input of the AND gate 16. The output of AND gate 16 is coupled to the input of a lamp driver 30. The output of the lamp driver 30 is coupled to a lamp 31 designated as GREEN. The other output or the high output of the flip/flop 20 is coupled to a buffer amplifier 32.

The output of amplifier 32 is directed to the intrusion detection system and operates to maintain the circuits in intrusion detection system 10 in a reset condition. In this manner, when the Q output or high output of flip/flop 20 is in the high condition, the intrusion detection system is disarmed and cannot operate. As will be explained, when the Q output is in the low condition or $\bar{Q}$ is in the high condition, the intrusion detection system is armed which indicates that it is functioning to monitor an intrusion on the premises.

Also shown is a voltage regulator 35. As is well known, the voltage regulator 35 operates to receive potential from the intrusion detection system and converts this potential to a regulated output voltage at the output terminal 36 which is sufficient to bias and energize the circuitry described above.

OPERATION OF THE CIRCUIT

The circuit operates as follows:

The momentary switch 25 is located on the premises at any desired position. Contained on the panel of the momentary switch is red lamp 29 and the green lamp 31. Let us assume that the intrusion system 10 has not been armed and that all the doors and windows are closed and hence, loop 11 is closed. Under these conditions, assume the operator wishes to activate the system as he is going to leave the premises. When the operator approaches the panel containing the switch 25, he will note that the green light will be on. This indicates that the loop 11 is closed. The operator noting that the green light is on, activates the switch 25. This causes the flip/-flop 20 to trigger and change state. In this manner, the green light is turned off via AND gate 16 and the red light goes on via the driver 28. The reset is removed due to the triggering of flip/flop 20 and the intrusion system is now activated or armed due to the removal of the reset. It is noted that if the loop 11 were opened, the green light would not be on and hence, if the operator then depressed switch 25, an alarm would be sounded due to the removal of the reset. Hence, if an operator sees that the green light is not on, he will then investigate the premises to assure that all entrances and exits are closed. This will turn the green lamp on and allow him to arm the system.

It is now noted that a plurality of additional panels can be positioned about the premises as desired. For example, another panel containing a momentary switch 55 in parallel with switch 25 and a red lamp 59 in parallel with lamp 29 and a green lamp 51 in parallel with lamp 31 can be positioned at other locations as desired and wired as shown by the diagram in dashed lines. In this manner, the user will have the same exact information available to him at the location of switch 55 and can arm or disarm the system via switch 55 as above described. It is noted that either switch 25 or switch 55 can arm the system. If the system has been armed, then either switch 25 or switch 55 can disarm the system. For example, if switch 25 is depressed again, the flip/flop 20 is again triggered and the red light will go off and the green light will come on. The reset via amplifier 32 will be applied to the detection system 10 and hence, the system will be disabled.

It should therefore be apparent that one may provide a plurality of switches as 25 and 55 with the associated red and green lamps throughout the premises in any desired locations to thus enable the arming or disarming of the intrusion detection system 10 from such remote locations.

It is understood that the above description shows a logic format which explains the basic operation and alternatives in regard to different types of gates and amplifiers as well as logic inverters can be implemented without departing from the scope and teachings of the invention as outlined above.

I claim:

1. In an intrusion detection system of the type operative to monitor an intrusion on a secured premises, said intrusion detection system operating to detect an open circuit in a loop of detector devices, which loop is normally closed when the premises are secured said intrusion detection system having an input terminal for arming said system upon application of a first signal thereto and for disarming said system for application of a second signal thereto, the combination therewith of apparatus for arming or disarming said system, comprising:

(a) first means coupled to said loop and operative to provide at an output a first status signal when said loop is closed and a second status signal when said loop is opened, (b) a first momentary switch adapted when operated to provide a pulse at an output, (c) a bistable multivibrator having an input terminal, and a first and second output terminal, said first output terminal coupled to said input terminal of said detection system operative to provide said first signal when said multivibrator is operated in a first state and said second signal when said multivibrator is operated in a second state, said second output terminal adapted to provide a signal indicative of said second signal when said multivibrator is operated in said first state and a signal indicative of said first signal when said multivibrator is operated in said second state, (d) logic means having one input terminal coupled to said output of said first means and a second input coupled to said second terminal of said bistable, to provide an output signal during the presence of said first status signal and for said bistable operated in said first mode, said output signal indicative of said loop being closed and said intrusion system being disarmed, (e) means coupling said output of said momentary switch to said input terminal of said bistable to alter said states of said bistable according to the operation of said momentary switch to therefore selectively arm or disarm said system according to said output signal as provided by said logic means.

2. The system according to claim 1 wherein said means coupling said momentary swtich output to said input of said bistable includes an integrator circuit operative to discriminate against undesirable contact bounce associated with said momentary switch.

3. The system according to claim 1 further including a first indicator means coupled to said output of said logic means to provide an indication of the presence of said output signal.

4. The system according to claim 1 further including second indicator means coupled to said second output terminal of said bistable to provide an indication when said intrusion system is armed due to the presence of said first signal at said input terminal of said intrustion detection means as coupled to said bistable.

5. The system according to claim 1 further including another momentary switch in parallel with said first momentary swtich and operative to alter the states of said bistable independent of said operation of said first switch.

6. The system according to claim 3 wherein said first indicator means includes a green colored lamp.

7. The system according to claim 4 wherein said second indicator means includes a red colored lamp.

8. The system according to claim 1 wherein said means coupling said output of said first momentary switch to said input terminal of said bistable includes a second multivibrator operating in a set/reset mode to provide a predetermined pulse each time said switch is operated.

9. The system according to claim 1 wherein said intrusion detection system is a fire detection system.

10. The system according to claim 1 wherein said intrusion detection system is a burglary detection system.

* * * * *